US011619104B2

(12) United States Patent
Schaeffer et al.

(10) Patent No.: US 11,619,104 B2
(45) Date of Patent: Apr. 4, 2023

(54) SHAPE MEMORY ALLOY SHAFT ALIGNMENT COUPLER FOR DOWNHOLE TOOLS

(71) Applicant: Halliburton Energy Services, Inc., Houston, TX (US)

(72) Inventors: Alexander J. Schaeffer, Spring, TX (US); Mukul M. Agnihotri, Spring, TX (US); Daniel P. Carter, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 183 days.

(21) Appl. No.: 17/065,864

(22) Filed: Oct. 8, 2020

(65) Prior Publication Data

US 2022/0112776 A1 Apr. 14, 2022

(51) Int. Cl.

| | |
|---|---|
| ***E21B 19/24*** | (2006.01) |
| ***E21B 17/02*** | (2006.01) |
| ***E21B 7/06*** | (2006.01) |

(52) U.S. Cl.

CPC ..... *E21B 19/24* (2013.01); *E21B 7/062* (2013.01); *E21B 7/067* (2013.01); *E21B 17/02* (2013.01)

(58) Field of Classification Search

CPC ..... E21B 19/24; E21B 17/02

See application file for complete search history.

(56) References Cited

U.S. PATENT DOCUMENTS

| | | | | |
|---|---|---|---|---|
| 4,013,134 | A | 3/1977 | Richmond et al. | |
| 4,904,228 | A | 2/1990 | Frear et al. | |
| 5,447,416 | A * | 9/1995 | Wittrisch | F04C 13/008 417/442 |
| 5,503,236 | A | 4/1996 | Tibbitts | |

(Continued)

FOREIGN PATENT DOCUMENTS

WO 2012140326 A1 10/2012

OTHER PUBLICATIONS

Beer; Ferdinand, Mechanics of Materials 2017, McGraw Hill, 7th Edition, A15 (Year: 2017).*

(Continued)

*Primary Examiner* — Nicole Coy
*Assistant Examiner* — Nicholas D Wlodarski
(74) *Attorney, Agent, or Firm* — Conley Rose, P.C.; Rodney B. Carroll

(57) ABSTRACT

An apparatus comprising a housing having a housing throughbore extending therethrough along a central axis; a motor drive shaft disposed in the housing throughbore; a component drive shaft disposed in the housing throughbore; and an alignment coupler mechanically coupling the motor drive shaft with the component drive shaft. The alignment coupler comprises: an alignment coupler body having an alignment coupler body throughbore extending therethrough; a spherical bolt comprising a spherical first end and an elongated section extending from the spherical first end to a second end; a thermally expandable material (TEM) section; a spring section comprising one or more springs; and one or more spherical spacers. The alignment coupler enables alignment of the motor drive shaft and the component drive shaft within the apparatus during assembly of the apparatus, and heating of the TEM provides rigidity to the assembled apparatus prior to use.

21 Claims, 4 Drawing Sheets

(56) References Cited

U.S. PATENT DOCUMENTS

| | | | | |
|---|---|---|---|---|
| 5,711,709 | A | 1/1998 | McCoy | |
| 2006/0278388 | A1 | 12/2006 | Zanca et al. | |
| 2017/0074439 | A1* | 3/2017 | Marincic | F16L 27/073 |
| 2017/0204675 | A1* | 7/2017 | Yu | E21B 10/60 |
| 2019/0331171 | A1* | 10/2019 | Toppazzini | F16F 1/32 |
| 2020/0018124 | A1* | 1/2020 | Hohl | E21B 17/1042 |
| 2020/0208511 | A1* | 7/2020 | Du | E21B 34/08 |

OTHER PUBLICATIONS

Foreign Communication from Related Application—International Search Report and Written Opinion of the International Searching Authority, International Application No. PCT/US2020/057328, dated Jun. 25, 2021, 11 pages.

* cited by examiner

SHAPE MEMORY ALLOY SHAFT ALIGNMENT COUPLER FOR DOWNHOLE TOOLS

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present disclosure relates generally to wellbore servicing operations. More specifically, this disclosure provides a self-alignment coupler for use in an adjustable two-piece drive shaft for a downhole tool, wherein the self-alignment coupler comprises a thermally expandable material (e.g., a shape memory alloy).

BACKGROUND

In tools comprising a drive shaft, alignment of the drive shaft within the tool can be challenging, and improper alignment of the drive shaft within the tool can lead to undesirable wear of tool components and a concomitant need for repair and maintenance.

Accordingly, an ongoing need exists for drive shaft assemblies that facilitate alignment of the drive shaft.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
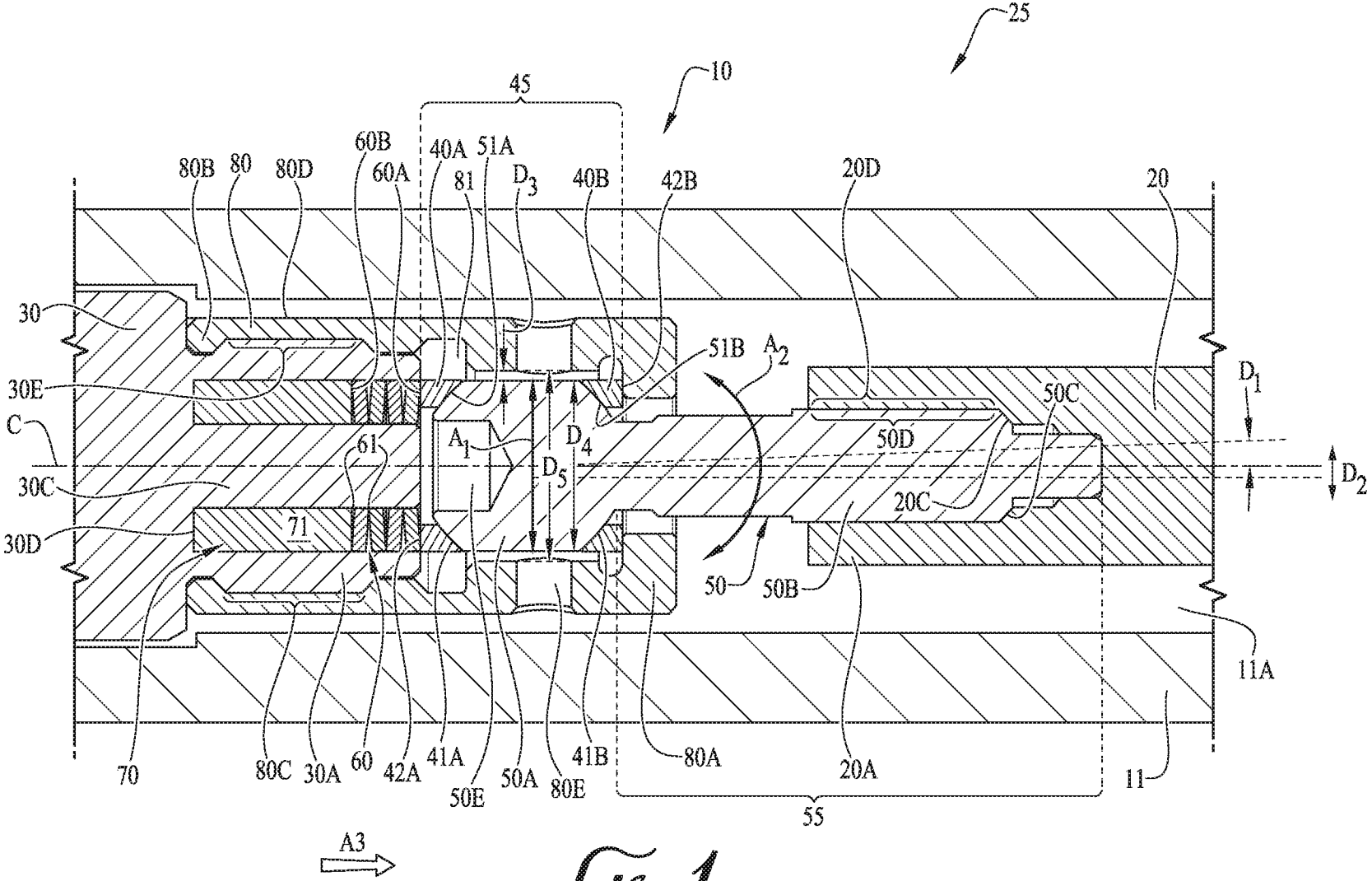
FIG. 1 is a schematic of a self-alignment coupler in a coupler assembly, according to embodiments of this disclosure.

It should be understood at the outset that although an illustrative implementation of one or more embodiments are provided below, the disclosed systems and/or methods can be implemented using any number of techniques, whether currently known or in existence. The disclosure should in no way be limited to the illustrative implementations, drawings, and techniques below, including the exemplary designs and implementations illustrated and described herein, but can be modified within the scope of the appended claims along with their full scope of equivalents.

Downhole tools with reciprocating shafts, such as in mud pulse telemetry tools, must provide that the shafts be well supported and aligned in the assembled tool in order to minimize friction and resulting power consumption (e.g., required to drive a valve), resist external shock and vibe loading, and ensure durability through the harshness of the downhole environment across as many cycles as possible (e.g., in a range of 1,000,000+ cycles). For example, to achieve best in-class data rates for mud pulsers, the mechanical parts within the valve system to drive the valve open and closed are subject to high cycle counts, and thus require a robust design to ensure reliability. While development of faster logging/measuring while drilling (L/MWD) data rate systems to gain an edge on the competition is needed to compete, such must be done with regards to minimizing costs as much as possible to improve margins for the business.

This disclosure addresses these key challenges by implementing a cost-effective shape memory alloy (SMA) alignment coupler (also referred to herein as a "self-alignment coupler (SAC)," an "alignment coupler," or simply a "coupler") with a 2-piece drive shaft design in the tool (e.g., a mud pulser assembly) to reduce operating costs, enhance reliability, and extend the life of the tool (e.g., extend the life of a mechanical valve system of a mud pulser assembly). Although sometimes referred to as an "SMA alignment coupler", it is to be understood that the alignment coupler of this disclosure can comprise any thermally expandable material (TEM), as described hereinbelow, which TEM is not limited to SMAs.

The SMA alignment coupler of this disclosure ensures a properly aligned and supported drive shaft within the tool (e.g., a mud pulser assembly). The SMA alignment coupler enables the tool (e.g., a pulser mechanical valve section of a mud pulser assembly) to operate efficiently with long life, low power consumption and cost-effective implementation.

The SMA alignment coupler of this disclosure contains a spherical joint between two components of a two component drive shaft (e.g., a motor drive shaft and a component (e.g., valve) drive shaft) which is adjustable at room temperature during an initial assembly. The SMA alignment coupler allows the component drive shaft to be adjustable through the spherical joint which allows the centerline to float and adjust in the angular direction. Utilization of the two-piece drive shaft assembly reduces the need for extremely tight tolerances when manufacturing the components, thus enabling the components to be more easily and economically manufactured.

During assembly of the tool comprising the two-piece drive shaft, misalignment between the motor drive shaft and the component drive shaft can be adjusted to center the shaft near perfectly (e.g., on support bearings). This alignment is enabled by the inventive SMA alignment coupler coupling the two components of the two piece drive shaft. In aspects, the drive shaft assembly can be contained within pressure housings that are exposed to the environment (e.g., to downhole mud flow and pressure) and cannot be easily accessed once installed within the housings.

The alignment coupler further comprises a TEM (e.g., a shape memory alloy (SMA)) that allows the alignment coupler to be adjustable during initial assembly and at room temperature. Once the drive shaft assembly has been properly aligned, the tool can be heated, thus allowing the TEM to expand and compress a spring section within the coupler or otherwise force the assembled shaft to become rigid. SMA is a unique family of metals which exhibit a temperature dependent shape change. The shape change is dramatic and capable of producing high enough deflection in the spring(s) of the spring section to provide sufficient force to lock the two-piece shaft assembly in place and subsequently resist loads experienced during operation (e.g., downhole loads). In aspects, the specific TEM or SMA utilized can maintain its expanded shape until cooled to a very low temperature (e.g., below −50° C.), below the expected operating temperature for the tool. The alignment coupler of this disclosure is thus adjustable during assembly, but becomes rigid upon heating and remains rigid during subsequent use, such that movement of the shaft due to pressure, shock, and vibration during operation (e.g., downhole) is prevented.

Disclosed herein are the alignment coupler described above, an assembly or "coupler assembly" (e.g., drive shaft assembly) comprising the alignment coupler, an apparatus or "tool" comprising the assembly, and a method of assembling such an assembly, and apparatus or tool.

Description of an alignment coupler according to this disclosure will now be made with reference to FIG. 1, which is a schematic of a self-alignment coupler 10 in a coupler assembly 25, according to embodiments of this disclosure. SAC 10 comprises: an alignment coupler body 80 having an alignment coupler body throughbore 81 extending therethrough; a spherical bolt 50 comprising a spherical first end 50A and an elongated section 55 extending from the spherical first end 50A to a second end 50B; a thermally expandable material (TEM) section 70 comprising a TEM 71; a spring section 60 comprising one or more springs 61; and one or more spherical spacers 40. The spherical first end (or "head") 50A of the spherical bolt 50 is disposed within the alignment coupler body throughbore 81. The second end (or "tail") 50B of the spherical bolt 50 is configured for coupling with a first end 20A of a component drive shaft 20. The TEM section 70 comprises a (e.g., ring of) TEM 71 configured to be disposed within a cavity 30D defined by a first end 30A of a motor drive shaft 30. The spring section 60 is configured to be disposed within the cavity 30D defined by the first end 30A of the motor drive shaft 30, and be positioned axially between the TEM section 70 and the spherical first end 50A of the spherical bolt 50. The one or more spherical spacers 40 are positioned between an outside diameter D4 of the spherical first end 50A of the spherical bolt 50 and an inside diameter D5 of the alignment coupler body 80.

As noted above, also disclosed herein is an assembly (e.g., a multicomponent or "2-piece" drive shaft) comprising two components coupled together via the SMA alignment coupler 10. For example, in aspects the assembly comprises a 2-piece drive shaft, and the two components coupled via the SMA alignment coupler 10 comprise the motor drive shaft 30 and the component drive shaft 20.

The spherical first end 50A of the spherical bolt 50 can further comprises a cutout section 50E. The cutout section 50E can comprise, for example, a hexagonal or other shaped recess. The first end 30A of the motor drive shaft 30 can further comprise a central section 30C. The central section 30C can be axially aligned with the cutout section 50E, such that should the motor drive shaft 30 be compressed axially in the direction indicated by arrow A3, central section 30C of motor drive shaft 30 can extend into cutout section 50E.

The second end 50B of the spherical bolt 50 can be coupled with the first end 20A of the component drive shaft 20 via any suitable coupling, such as, for example, threading. Alternatively, the second end 50B of the spherical bolt 50 can be coupled with the component drive shaft 20 via a lock ring, a press fit, or another mechanical coupling.

TEM 71 can comprise any material or materials having a favorable coefficient of thermal expansion to provide sufficient deflection of the springs of spring section 60 to resist (e.g., downhole) loading of the assembled shaft assembly 25. That is, the TEM 71 has a suitable coefficient of thermal expansion, such that, upon heating, the TEM section 70 compresses the spring(s) of spring section 60 and locks the 2-piece drive shaft assembly 25 into rigid position. For example, in embodiments, the TEM 71 has a coefficient of thermal expansion greater than that of polyether ether ketone (PEEK). In embodiments, the TEM 71 has a coefficient of thermal expansion of greater than or equal to about $2\times10^{-5}$, $2.5\times10^{-5}$, or $3\times10^{-5}$ in/in/° F.

In embodiments, the TEM 71 can comprise a shape memory alloy (SMA). Suitable SMAs include, for example and without limitation, copper-aluminum-nickel, nickel-titanium (NiTi), iron-manganese-silicon (Fe—Mn—Si), copper-zinc-aluminum (Cu—Zn—Al), copper-aluminum-nickel (Cu—Al—Ni), nickel-titanium-iron (NiTiFe), nickel-titanium-niobium (NiTiNb), or a combination thereof. In aspects, the SMA comprises an alloy of zinc, copper, gold, iron, aluminum, nickel, titanium, manganese, niobium, and/or silicon. The TEM 71 (e.g., SMA) can be designed to expand in a specific direction upon heating. For example, in embodiments, upon heating, the TEM 71 (e.g., SMA) can preferentially expand axially (e.g., in direction indicated by A3) to a greater degree than it expands radially (e.g., in directions indicated by arrow A1).

Figure 2:
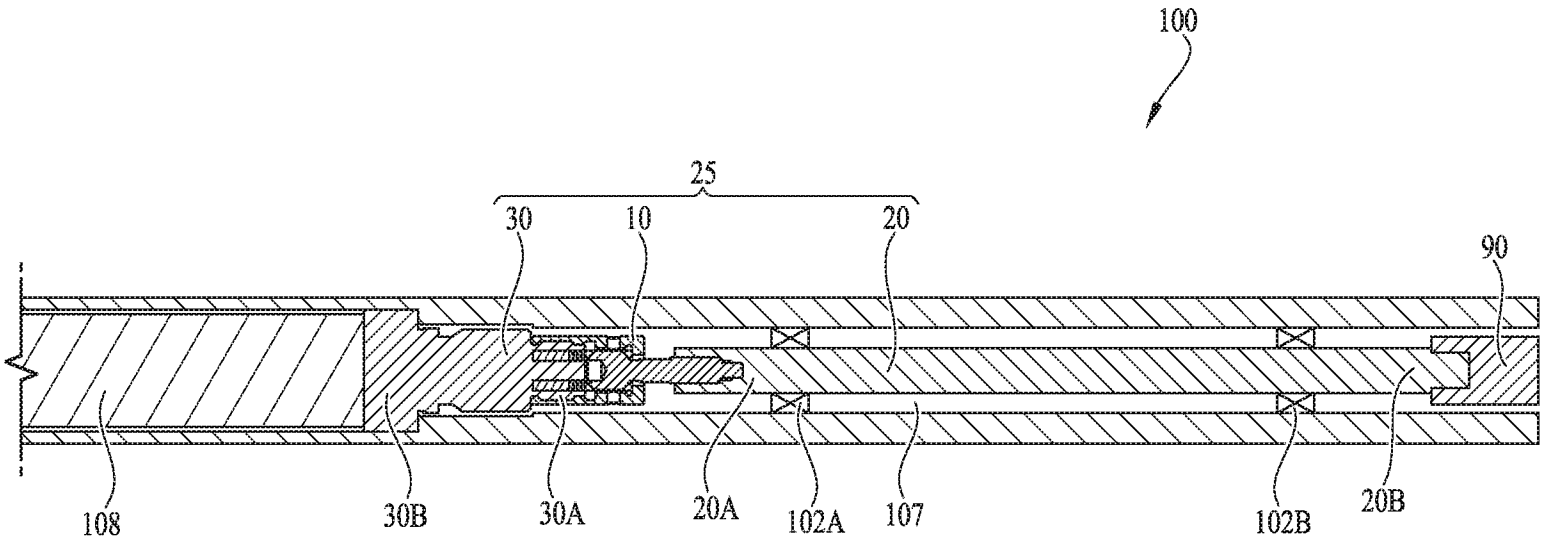
FIG. 2 is a schematic of an apparatus or tool comprising the coupler assembly of FIG. 1, according to embodiments of this disclosure.

Spring section 60 comprises one or a plurality of springs 61. In some embodiments, the spring section 60 comprises one or a plurality of Belleville springs 61 (also referred to as "Belleville washers"). Alternatively or additionally, spring section 60 comprises one or a plurality of solid springs, wave springs, compression springs, or other component(s) that has(have) properties capable of applying axial force to the two-piece shaft assembly 25 to resist operational loading (e.g., downhole loading experienced during operation of tool 100 (FIG. 2) comprising the assembly 25 comprising the alignment coupler 10). Belleville springs can be selected and stacked in specific configurations (e.g., with associated deflections and spring constants) to provide a desired total holding force on the component drive shaft 20.

As depicted in the embodiment of FIG. 1, the one or more spherical spacers 40 can comprise a first spherical spacer 40A and a second spherical spacer 40B. The first spherical spacer 40A can comprise a spherical surface 41A in contact with a front spherical surface 51A of the spherical first end 50A of the spherical bolt 50, and the second spherical spacer 40B can comprise a spherical surface 41B in contact with a back spherical surface 51B of the spherical first end 50A of the spherical bolt 50. An axially opposite surface 42 (e.g., axially opposite surface 42A of first spherical spacer 40A) of one of the one or more spherical spacers 40 (e.g., first spherical spacer 40A) can be adjacent the spring section 60. The axially opposite surface 42 (e.g., axially opposite surface 42B of second spherical spacer 40B) of another of the one or more spherical spacers 40 (e.g., second spherical spacer 40B) can contact the alignment coupler body 80, when the assembly is assembled. Spherical spacer(s) 40 and associated spherical bolt 50, which can pivot against the spherical spacers 40, make up a spherical joint 45. Spherical joint 45 can, in embodiments, consist of two spherical spacers (e.g., first spherical spacer 40A and second spherical spacer 40B) and spherical bolt 50.

The one or more spherical spacers 40 can be made of a non-galling material, for example, a material having a coefficient of friction of less than or equal to about 0.2, 0.15, or 0.1. The assembly 25 can be lubricated with, for example, a lubricating oil. Such lubricating oil can be positioned between first end 50A of spherical bolt 50 and an inner surface 80F of SAC body 80 and between the one or more spherical spacers 40 and the inner surface 80F of SAC body 80. For example, an outside diameter D4 of the spherical first end 50A of the spherical bolt 50 can be less than the inside diameter D5 of the alignment coupler body 80, and lubricating oil can be positioned in the gap D3 therebetween. For example and without limitation, the outside diameter D4 of the spherical first end 50A of the spherical bolt 50 can be less than the inside diameter D5 of the alignment coupler body 80 by greater than or equal to about 0.03, 0.04, or 0.05 in (0.76, 1.02, or 1.27 mm). It is to be understood that such dimensions are exemplary, and can vary depending on the specific geometry of the SAC 10 and the components being coupled thereby.

The motor drive shaft 30 can be coupled with the SAC body 80 by any suitable coupling. For example, in embodiments, a threaded motor drive shaft contact surface 80C of the alignment coupler body 80 is threadably coupled with a threaded alignment coupler body contact surface 30E of the first end 30A of the motor drive shaft 30. Alternatively, the motor drive shaft 30 can be coupled with the SAC body 80 via a lock ring, a press fit, or another mechanical coupling.

The specific amount of radial float provided by the SMA alignment coupler 10 can be dependent on the specific geometry for which the SMA alignment coupler 10 is designed. By way of example, and without limitation, the alignment coupler 10 can enable a radial float D2 of the spherical bolt 50 along the central axis C of greater than or equal to about ±0.02 inch, ±0.025 in, or ±0.03 inch (±0.5 mm, ±0.6 mm, or ±0.8 mm) or more. Similarly, the SMA alignment coupler 10 can provide spherical movement of the spherical bolt 50. For example and without limitation, the alignment coupler 10 can enable spherical movement D1 of the spherical bolt 50 of greater than or equal to about 1, 2, or 3 degrees (°) or more. The spherical movement provided can be highly dependent on the overall geometry and design of the assembly 25, and more or less spherical movement is envisioned, in embodiments.

SMA alignment coupler 10 is thus positioned between two components of two component shaft assembly 25. On one side, the motor drive shaft 30 is fixed and houses cavity 30D for TEM 71/TEM section 70 (e.g., a shape memory alloy washer(s)) which itself contacts a spring(s) 61 of spring section 60 (e.g., a Belleville spring stack). The spring section 60 is designed such that the when the TEM 71 (e.g., SMA) is heated, it expands, thus generating an increased spring force, selected to be sufficient to resist any loading (e.g., downhole loading) placed on the component drive shaft 20 (e.g., valve component drive shaft 20) during operation.

The spring section 60 abuts spherical joint 45, comprising spacer(s) 40 (e.g., two spherical spacers) and spherical bolt 50, which can pivot against the spherical spacer(s) 40, until the TEM 71 is heated to lock the assembly 25 in rigid alignment. When assembled, spherical joint 45 is housed within coupler body 80, which threads or otherwise connects to the motor drive shaft 30, as described hereinabove. Self-alignment coupler body 80 can be specifically sized (i.e., the size thereof selected) to allow a pre-determined amount of alignment adjustment with the spherical joint 45, in the form of radial float (as depicted in FIG. 1 by D2) and angular or spherical movement (as depicted in FIG. 1 by D1). This sizing can be tailored to match various sizes of shafts (e.g., of component shaft 20) that are being considered in the (e.g., downhole) tool 100.

During assembly, which is described in more detail hereinbelow with reference to FIG. 4, when the self-alignment coupler 10 is installed between the two components/shafts (i.e., motor drive shaft 30 and component drive shaft 20) of the two-piece shaft assembly 25, SAC 10 is free to move and is easily adjustable. Component (e.g., valve) drive shaft 20 is supported by one or more bearings (e.g., bearings 102A/102B described hereinbelow with reference to FIG. 2) that center the component drive shaft 20 within the assembly 25, reduce friction, and support loading to the component drive shaft 20. The bearings are normally fixed in a certain position(s), and in cases of tolerance stack-up with multiple parts in the assembly 25, a long solid component drive shaft 20 may bring challenges when being assembled to the bearings and/or may cause added stress and increased friction if an improper fit exists. This can undesirably result in pre-mature failure of the drive system (e.g., a motor 108). The SMA alignment coupler 10 allows the two-piece shaft assembly 25 to be fully adjustable, prior to heating, such that good alignment to the bearings can be effected during assembly of the tool 100.

The adjustability provided by the SMA alignment coupler 10 during assembly can allow the drive shaft assembly 25 to be fully centered, but would not adequately resist downhole loads and vibration, without being locked in prior to use. This issue is solved by the use of the springs 61 of spring section 60. Once the two-piece drive shaft assembly 25 is aligned (e.g., the component drive shaft 20 is positioned correctly relative to motor drive shaft 30), the assembly 25 (or at least TEM section 70 comprising TEM 71) can be heated. Upon heating, TEM 71 (e.g., an SMA washer) of TEM section 70 will expand, compressing the springs 61 of spring section 60, and forcing the component drive shaft 20 to become rigidly coupled with the motor drive shaft 30, and thus resistant to subsequent loading. In aspects, the heating comprises heating to a transition temperature above which the TEM expands (e.g., to a temperature in the range of from about 75 to about 115° C., from about 80 to about 110° C., or from about 85 to about 100° C.), which transition temperature can be well below a subsequent (e.g., downhole) operating temperature range (e.g., an operating temperature range of from about 130° C. to about 180° C., from about 140° C. to about 170° C., or from about 150° C. to about 165° C.). In aspects, the TEM 71 can maintain its expanded state up well above operational limits (e.g., to at least 200, 250, or 300° C.) and will not change shape until cooling to a temperature well below operating limits (e.g., below about 0, −10, −20, −30, −40, or −50° C.), thus ensuring maintenance of a rigid assembly 25 during the operation of the tool 100 downhole.

As noted hereinabove, further disclosed herein is an apparatus or tool comprising the coupled assembly comprising the SMA alignment coupler 10. Description of such an apparatus or tool will now be made with reference to FIG. 2, which is a schematic of an apparatus or tool 100 comprising a coupled assembly 25 comprising the SMA alignment coupler 10. Apparatus or tool 100 comprises: a housing 11 having a housing throughbore 11A extending therethrough along a central axis C; a motor drive shaft 30 disposed in the housing throughbore 11A; a component drive shaft 20 disposed in the housing throughbore 11A; and the alignment coupler 10, as described hereinabove, mechanically coupling the motor drive shaft 30 with the component drive shaft 20. As detailed hereinabove, the alignment coupler 10 comprises: alignment coupler body 80 having an alignment coupler body throughbore 81 extending therethrough; spherical bolt 50 comprising spherical first end 50A and elongated section 55 extending from the spherical first end to second end 50B; thermally expandable material (TEM) section 70 comprising TEM 71; spring section 60 comprising one or more springs 61; and one or more spherical spacers 40. As described hereinabove, the spherical first end 50A of the spherical bolt 50 is disposed within the alignment coupler body throughbore 81, the second end 50B of the spherical bolt 50 is coupled with a first end 20A of the component drive shaft 20, the TEM section 70 comprises a (e.g., ring of) TEM 71 disposed within cavity 30D defined by first end 30A of the motor drive shaft 30, spring section 60 is disposed within the cavity 30D defined by first end 30A of motor drive shaft 30, and is positioned axially between TEM section 70 and spherical first end 50A of spherical bolt 50, and the one or more spherical spacers 40 are axially positioned between outside diameter D4 of spherical first end 50A of spherical bolt 50 and inside diameter D5 of alignment coupler body 80.

The apparatus or tool 100 can be an oilfield services tool 100. The apparatus or tool 100 can comprise, for example, a positive displacement pump, a mud pulser, a rotary steerable tool, a logging while drilling (LWD) tool, a measuring while drilling (MWD) tool, a mud sampling tool, or a downhole generator. Although generally described herein as being utilized in a downhole wellbore servicing tool 100, it is envisioned that the self-alignment coupler 10, and the assembly 25 comprising the SAC 10 of this disclosure are suitable for use in a variety of tools, wellbore servicing and otherwise. For example, any device or tool that has a moving shaft can be more easily aligned (e.g., the shaft aligned within the tool) by using the self-alignment coupler 10 described herein.

The apparatus or tool 100 can further comprise a motor 108 (e.g., a DC motor or other mechanism) connected to the motor drive shaft 30. The apparatus or tool comprises a component coupled to a second end 20B of the component drive shaft 20. In aspects, the component comprises a mud pulser valve 90, and the apparatus 100 comprises a mud pulser. The apparatus or tool 100 can further comprise one or more bearings 102 supporting the component drive shaft 20 within the housing 11. The apparatus or tool 100 can further comprise a spring radially positioned between the alignment coupler 10 and the housing 11 to, for example, maintain valve 90 in a normally closed position, such that valve 90 doesn't get stuck in an open position. In aspects, the mud pulser apparatus or tool 100 is capable of adjusting pulse amplitude on the fly via downlinking and delivering data rates up to or above 10, 11, 12, 13, 14, or 15 bits per second (bps). In aspects, the self-alignment coupler 10 is utilized in a downhole tool 100 (e.g., a mud pulser tool 100) that delivers such a high-data rate service to provide real-time data from M/LWD platforms.

Figure 3:
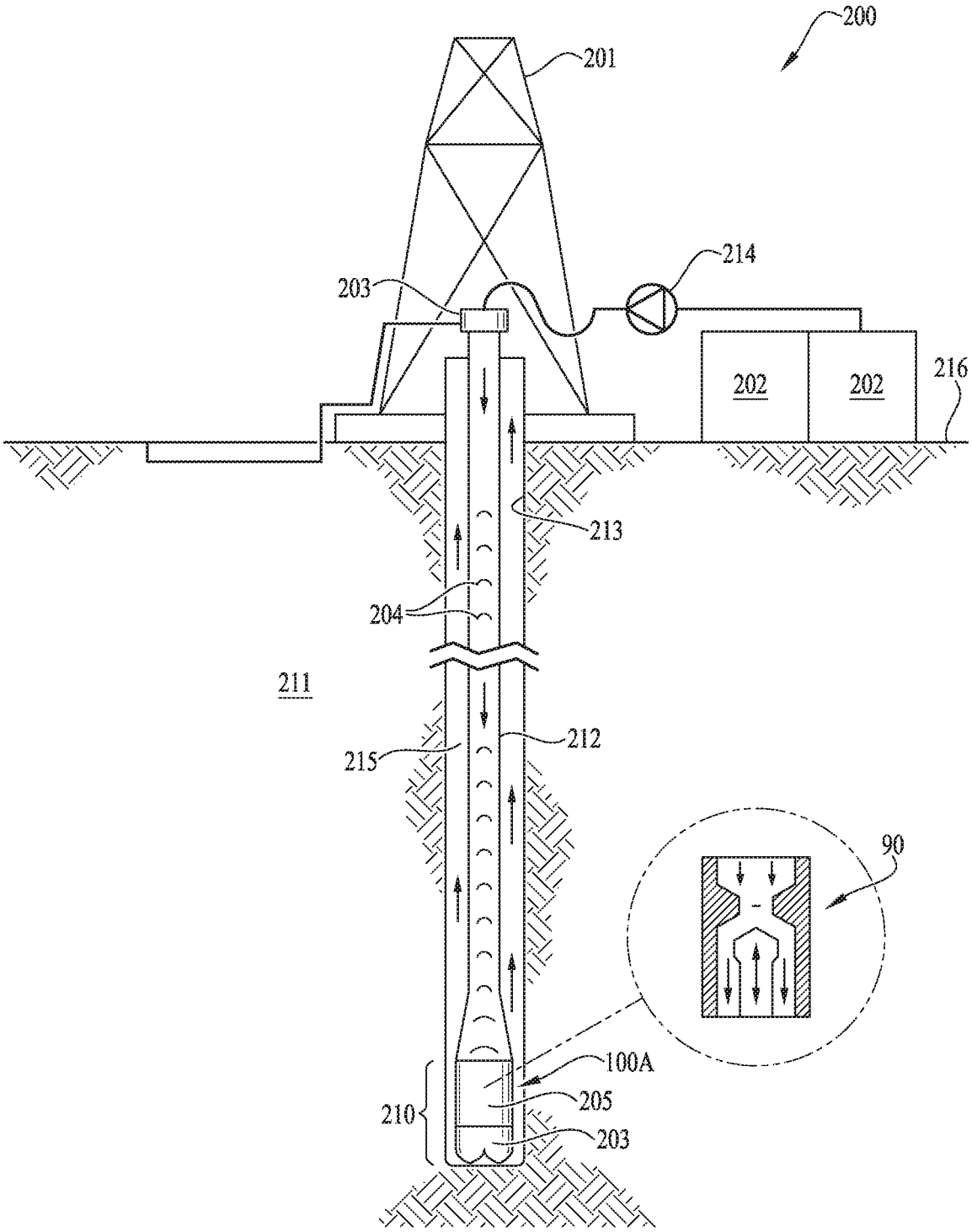
FIG. 3 is a schematic of a wellbore servicing environment in which a wellbore servicing tool, such as that depicted in FIG. 2, can be utilized, according to embodiments.

As depicted in FIG. 3, which is a schematic of a wellbore environment 200 in which a mud pulser 100A can be utilized, the mud pulser 100A can be a component of a bottom hole assembly (BHA) 210. BHA 210 is positioned within borehole 213, which can be positioned below drilling rig 201. Mud pumps 214 can pump drilling fluid or "mud" from one or more mud tanks 202 into drill string 212 and through BHA 210, out drill bit 203 and back up borehole 213 via annulus 215 between walls of the borehole 213 and the drillstring 212. The mud pulser 100A can be positioned within a sonde mounted inside an inside diameter of a drill collar 212. BHA 210 can include one or more sensors 205, and a pressure sensor 203 can be positioned above ground, e.g., at a top of the drillstring 212.

With reference back to FIG. 2, the mud pulser 100A can further comprise additional components, and can be a mud pulser as generally known to those of skill in the art, but, rather than comprising a one piece or other conventional drive shaft, comprising 2-piece drive shaft assembly 25 comprising motor drive shaft 30 and component drive shaft 20 coupled via SMA alignment coupler 10, as described hereinabove. For example, apparatus/mud pulser 100 of the embodiment of FIG. 2 can further comprise motor 108.

Also disclosed herein is a method of utilizing the apparatus or tool 100 comprising the assembly or multi-component (e.g., two-piece) drive shaft 25 comprising the SMA alignment coupler 10. Description of a method of this disclosure will now be made with reference to FIG. 4, which is a flow diagram of a method 400 according to embodiments of this disclosure. As depicted of FIG. 4, method 400 comprises, at 410, assembling a tool 100 with a multi-component drive shaft assembly 25 comprising a motor drive shaft 30 and a component drive shaft 20 coupled via an alignment coupler 10. As detailed hereinabove the alignment coupler 10 comprises: alignment coupler body 80 having alignment coupler body throughbore 81 extending therethrough; spherical bolt 50 comprising spherical first end 50A and elongated section 55 extending from spherical first end 50A to second end 50B; thermally expandable material (TEM) section 70 comprising TEM 71; spring section 60 comprising one or more springs 61; and one or more spherical spacers 40, wherein spherical first end 50A of spherical bolt 50 is disposed within alignment coupler body throughbore 81, wherein second end 50B of spherical bolt 50 is coupled with first end 20A of component drive shaft 20, wherein TEM section 70 comprises (e.g., a ring of) TEM 71 disposed within cavity 30D defined by first end 30A of motor drive shaft 30, wherein spring section 60 is disposed within cavity 30D defined by first end 30A of motor drive shaft 30, and is positioned axially between TEM section 70 and spherical first end 50A of spherical bolt 50, and wherein the one or more spherical spacers 40 are positioned between outside diameter D4 of spherical first end 50A of spherical bolt 50 and inside diameter D5 of alignment coupler body 80. As depicted in FIG. 4, assembling the tool 100 with multi-component drive shaft assembly 25 comprising motor drive shaft 30 and component drive shaft 20 coupled via alignment coupler 10 at 410 can further comprise: coupling the component drive shaft 20 with the motor drive shaft 30 via the alignment coupler 10 to provide the multi-component drive shaft 25 at 411, aligning the multi-component drive shaft 25 within the housing 11 at 412; and heating the TEM section 70, such that the TEM 71 expands axially to lock the multi-component drive shaft 25 in position within the housing 11 at 413. The expanded position of the TEM 71 maintains its shape throughout the entire operating range while the apparatus or tool 100 comprising the SMA alignment coupler 10 is in service.

Coupling the component drive shaft 20 with the motor drive shaft 30 at 411 can further comprise: positioning the spherical first end 50A of the spherical bolt 50 and the one or more spherical spacers 40 within the alignment coupler body 80; coupling the second end 50B of the spherical bolt 50 with the first end 20A of the component drive shaft 20; and coupling the first end 30A of the motor drive shaft 30 with the alignment coupler body 80. Coupling the second end 50B of the spherical bolt 50 with the first end 20A of the component drive shaft 20 can further include threading a threaded spherical bolt contact portion 20D of the component drive shaft 20 with a threaded component drive shaft contact portion 50D of the spherical bolt 50. Coupling the first end 30A of the motor drive shaft 30 with the alignment coupler body 80 can further include threading a threaded motor drive shaft contact surface 80C of the alignment coupler body 80 with a threaded alignment coupler body contact surface 30E of the first end 30A of the motor drive shaft 30.

In aspects, positioning the spherical first end 50A of the spherical bolt 50 and the one or more spherical spacers 40 within the alignment coupler body 80 can further comprise passing the second end 50B of the spherical bolt 50 through the alignment coupler body throughbore 81. The method can further comprise positioning first spherical spacer 40A, second spherical spacer 40B, or both first spherical spacer 40A and second spherical spacer 40B about an outside diameter D4 of first end 50A of spherical bolt 50 prior to positioning spherical first end 50A of spherical bolt 50 and one or more spherical spacers 40 within alignment coupler body 80, such that spherical surface 41A of first spherical spacer 40A contacts front spherical surface 51A of first end 50A of spherical bolt 50 and spherical surface 41B of second spherical spacer 40B contacts back spherical surface 51B of first end 50A of spherical bolt 50.

The method can further include positioning the TEM 71 in the TEM section 70 within the cavity 30D defined by the motor drive shaft 30 and positioning one or more springs in the spring section 60 within the cavity 30D defined by the motor drive shaft 30 prior to coupling the first end 30A of the motor drive shaft 30 with the alignment coupler body 80, whereby a first end 60A of the spring section 60 contacts one of the one or more spacers and a second end 60B of the spring section contacts the TEM 71 of the TEM section 70.

Coupling the first end 30A of the motor drive shaft 30 with the alignment coupler body 80 can cause the spring section 60 to apply a pre-load pressure on the spherical bolt 50.

Once the drive shaft assembly 25 is coupled with self-alignment coupler 10, housing 11, with bearings 102A/102B can be positioned about (e.g., slid over) the rigid drive shaft assembly 25 and component drive shaft 20 aligned therein, prior to heating to expand TEM 71 of TEM section 70 at 413.

As noted hereinabove, heating at 413 can comprise heating to a temperature above a transition temperature above which the TEM 71 begins to expand. The heating is effected to expand the TEM 71 of the TEM section 70, thus compressing the spring section 60 and locking the drive shaft assembly 25 rigidly into position, and will depend on the specific TEM (e.g., SMA) utilized. By way of example, and without limitation, the transition temperature can be in a range of from about 75° C. to about 175° C., from about 100° C. to about 150° C., or from about 110° C. to about 140° C., or a temperature of greater than or equal to about 75, 80, 85, 80, 95, 100, 105, 110, 115, 120, 125, 130, 135, 140, 145, 150, 155, 160, 165, 170, or 175° C.

Figure 4:
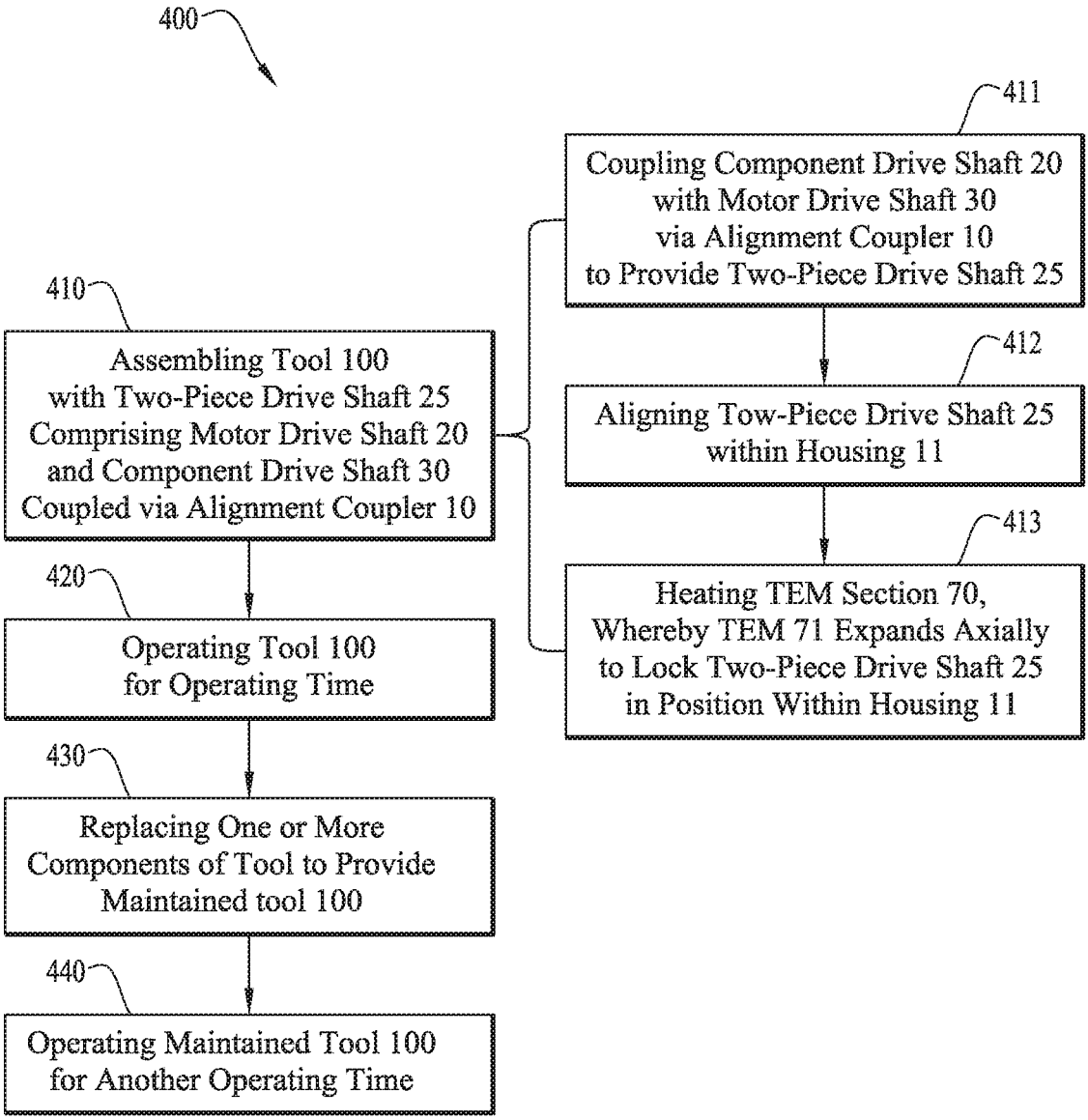
FIG. 4 is a flow diagram of a method according to embodiments of this disclosure.

As depicted in FIG. 4, method 400 can further include: operating the tool 100 for an operating time at 420; replacing one or more components of the tool 100 at 430, to provide a maintained tool 100; and operating the maintained tool 100 for another operating time at 440. Replacing the one or more components of the tool 100 at 430 can further comprise cooling the TEM section 70 to a temperature at which the TEM 71 contracts (as discussed hereinabove) and decoupling the component drive shaft 20 from the multi-component drive shaft 25. Replacing the one or more components at 430 can further comprise decoupling the component drive shaft 20 from the assembled multi-component drive shaft 25 and replacing the decoupled component drive shaft 20 with another (e.g., a new or repaired) component drive shaft 20.

In aspects, as noted hereinabove, the apparatus or tool 100 comprises a mud pulser, the component drive shaft 20 is a valve drive shaft 20, and the second end 20B of the component drive shaft 20 is coupled with a pulser valve 90. Second end 30B of the motor drive shaft 30 is coupled with a motor 108. In such aspects, a mud pulser assembly 25 of this disclosure can comprise: housing 11 having housing throughbore 11A extending therethrough along central axis C; motor drive shaft 30 disposed in housing throughbore 11A and coupled to a motor 108; valve drive shaft 20 disposed in housing throughbore 11A and coupled to valve 90; and alignment coupler 10 mechanically coupling motor drive shaft 30 with valve drive shaft 20, wherein the alignment coupler 10 is as detailed hereinabove. The alignment coupler 10 comprises: alignment coupler body 80 having alignment coupler body throughbore 81 extending therethrough; spherical bolt 50 comprising spherical first end 50A and elongated section 55 extending from spherical first end 50A to second end 50B; thermally expandable material (TEM) section 70; spring section 60 comprising one or more springs 61; and one or more spherical spacers 40, wherein spherical first end 50A of spherical bolt 50 is disposed within alignment coupler body throughbore 81, wherein second end 50B of spherical bolt 50 is coupled with first end 20A of valve drive shaft 20, wherein the TEM section 70 comprises (e.g., a ring of) TEM 71 disposed within cavity 30D defined by first end 30A of motor drive shaft 30, wherein spring section 60 is disposed within cavity 30D defined by first end 30A of motor drive shaft 30, and is positioned axially between TEM section 70 and spherical first end 50A of spherical bolt 50, and wherein the one or more spherical spacers 40 are positioned between outside diameter D4 of spherical first end 50A of spherical bolt 50 and inside diameter D5 of alignment coupler body 80.

As noted hereinabove, the method can comprise operating tool 100 for an operating time at 420 and/or operating the maintained tool 100 for another operating time at 440. Operating the tool 100 at 420 and/or operating the tool 100 at 440 can be performed as known in the art. For example, in aspects, the tool 100 comprises a mud pulser tool 100, for performing mud pulse telemetry, which is a method of transmitting information (e.g., LWD and MWD data acquired downhole) through a flowing column of drilling mud to a surface 216 of the wellbore. In mud pulse telemetry, the pressure on the flowing mud column (e.g., within drill string 212 of FIG. 3) at a point downhole (e.g., within borehole 213) is periodically modulated by mechanical means, and the resulting periodic pressure pulses appearing at the surface end of the mud column can be detected by a pressure sensor 203 (e.g., a pressure transducer). The mud pulser tool 100, comprising the SAC 10, can be utilized to modulate the pressure on the flowing mud column. The mud pulses 204 are produced by valve component 90 that opens and closes to restrict the circulating flow. Information can be conveyed by the presence or absence of mud pulses 204, or by the relative duration of the mud pulses 204 in a sequence. The measurements can be converted into an amplitude- or frequency-modulated pattern of mud pulses 204. The mud telemetry system, comprising mud pulser tool 100, can also be used to transmit commands from the surface 216. Details of mud pulsing will be apparent to those of skill in the art of mud pulse telemetry, and will not be provided here.

The self-alignment coupler 10 of this disclosure enables enhanced design of downhole tools 100, providing for improves cost-effectiveness for potentially complex tools that can, in embodiments, be utilized in very demanding applications (e.g., downhole). For example, in embodiments, a high-data rate mud pulser tool 100 can employ the self-alignment coupler 10 as described herein to facilitate alignment of a two-piece shaft assembly therein.

The disclosed self-alignment coupler 10 allows the two pieces of the two piece shaft (e.g., the motor drive shaft 30 and the component drive shaft 20) to be coupled and initially adjustable. The coupler facilitates alignment of the two-piece shaft 25 within the tool 100, which can be especially beneficial in environments in which the tool is not readily accessible (e.g., in a downhole environment, where the self-alignment coupler 10 is not exposed, but is contained within a pressure housing 11 or similar to guard against mud flow). The self-alignment coupler 10 described herein comprises TEM section 70 (e.g., comprising TEM 71, such as shape memory alloy) to overcome this challenge.

As described hereinabove, during assembly of the apparatus or tool 100, the SMA shaft coupler 10 contained within pressure housing 111 is fully adjustable, but is locked in-place after assembly via heating of the TEM 71 (e.g., shape-memory alloy) to compress a spring(s) 61 of spring section 60 in the shaft self-alignment coupler 10, such that the locked in-place assembly 25 can resist any operational loads encountered during subsequent operation of apparatus or tool 100.

Self-alignment coupler 10 employs a spherical joint 45 that allows for large radial float D2 in shaft centerline and a large float D1 in angular adjustment (e.g., ±1°), as detailed hereinabove.

The adjustable two-piece shaft assembly 25 can reduce repair and maintenance costs associated with the apparatus or tool 100 relative to shafts that are conventionally machined as a one-piece shaft. One piece shafts can be relatively expensive to machine and replace and highly susceptible to wear-out, whereas the two-piece shaft assembly 25 described herein can, in embodiments, be more easily serviced, for example by replacing a cheaper section of the two-piece shaft (e.g., the component drive shaft 20) that is more prone to wear-out (e.g., than the motor drive shaft 30).

EXAMPLES

The embodiments having been generally described, the following examples are given as particular embodiments of the disclosure and to demonstrate the practice and advantages thereof. It is understood that the examples are given by way of illustration and are not intended to limit the specification or the claims in any manner.

Example 1

In embodiments, the self-alignment coupler 10 is utilized to couple a motor drive shaft 30 and a valve drive shaft 20 into a two-piece drive shaft 25 of a mud pulser assembly. In such embodiments, the mud pulser assembly comprises: a housing 11 having a housing throughbore 11A extending therethrough along a central axis C; a motor drive shaft 30 disposed in the housing throughbore 11A and coupled to a motor 108; a valve drive shaft 20 disposed in the housing throughbore 11A and coupled to a valve 90; and an alignment coupler 10 mechanically coupling the motor drive shaft 30 with the valve drive shaft 20. The alignment coupler 10 comprises: an alignment coupler body 80 having an alignment coupler body throughbore 81 extending therethrough; a spherical bolt 50 comprising a spherical first end 50A and an elongated section 55 extending from the spherical first end to a second end 50B; a thermally expandable material (TEM) section 70; a spring section 60 comprising one or more springs 61; and one or more spherical spacers 40. The spherical first end 50A of the spherical bolt 50 is disposed within the alignment coupler body throughbore 81. The second end 50B of the spherical bolt 50 is coupled with a first end 20A of the valve drive shaft 20. The TEM section 70 comprises TEM 71 (e.g., a ring of TEM 71) disposed within a cavity 30D defined by a first end 30A of the motor drive shaft 30. The spring section 60 is disposed within the cavity 30D defined by the first end 30A of the motor drive shaft 30, and is positioned axially between the TEM section 70 and the spherical first end 50A of the spherical bolt 50. The one or more spherical spacers 40 are positioned between an outside diameter D4 of the spherical first end 50A of the spherical bolt 50 and an inside diameter D5 of the alignment coupler body 80.

Additional Disclosure

The following are non-limiting, specific embodiments in accordance with the present disclosure:

In a first embodiment, an apparatus comprises: a housing 11 having a housing throughbore 11A extending therethrough along a central axis C; a motor drive shaft 30 disposed in the housing throughbore 11A; a component drive shaft 20 disposed in the housing throughbore 11A; and an alignment coupler 10 mechanically coupling the motor drive shaft 30 with the component drive shaft 20, wherein the alignment coupler 10 comprises: an alignment coupler body 80 having an alignment coupler body throughbore 81 extending therethrough; a spherical bolt 50 comprising a spherical first end 50A and an elongated section 55 extending from the spherical first end to a second end 50B; a thermally expandable material (TEM) section 70; a spring section 60 comprising one or more springs 61; and one or more spherical spacers 40, wherein the spherical first end 50A of the spherical bolt 50 is disposed within the alignment coupler body throughbore 81, wherein the second end 50B of the spherical bolt 50 is coupled with a first end 20A of the component drive shaft 20, wherein the TEM section 70 comprises a ring of TEM 71 disposed within a cavity 30D defined by a first end 30A of the motor drive shaft 30, wherein the spring section 60 is disposed within the cavity 30D defined by the first end 30A of the motor drive shaft 30, and is positioned axially between the TEM section 70 and the spherical first end 50A of the spherical bolt 50, and wherein the one or more spherical spacers 40 are axially positioned between an outside diameter D4 of the spherical first end 50A of the spherical bolt 50 and an inside diameter D5 of the alignment coupler body 80.

A second embodiment can include the apparatus of the first embodiment, wherein the apparatus is an oilfield services tool.

A third embodiment can include the apparatus of the first embodiment or the second embodiment, wherein the spherical first end 50A of the spherical bolt 50 further comprises a cutout section 50E.

A fourth embodiment can include the apparatus of the third embodiment, wherein the cutout section 50E comprises a hexagonal recess.

A fifth embodiment can include the apparatus of the third embodiment or the fourth embodiment, wherein the first end 30A of the motor drive shaft 30 further comprises a central section 30C, wherein the central section 30C is axially aligned with the cutout section.

A sixth embodiment can include the apparatus of any one of the first to fifth embodiments, wherein the second end 50B of the spherical bolt 50 is coupled with the first end 20A of the component drive shaft 20 via threading.

A seventh embodiment can include the apparatus of any one of the first to sixth embodiments, wherein the TEM 71 comprises shape memory alloy.

An eighth embodiment can include the apparatus of any one of the first to seventh embodiments, wherein the TEM 71 has a coefficient of thermal expansion of greater than or equal to about $2\times10^{-5}$, $2.5\times10^{-5}$, or $3\times10^{-5}$ in/in/° F.

A ninth embodiment can include the apparatus of any one of the first to eighth embodiments, wherein the spring section 60 comprises one or a plurality of Belleville springs.

A tenth embodiment can include the apparatus of any one of the first to ninth embodiments, wherein the one or more spherical spacers 40 comprise a first spherical spacer 40A and a second spherical spacer 40B, wherein the first spherical spacer 40A comprises a spherical surface 41A in contact with a front spherical surface 51A of the spherical first end 50A of the spherical bolt 50, and wherein the second spherical spacer 40B comprises a spherical surface 41B in contact with a back spherical surface 51B of the spherical first end 50A of the spherical bolt 50.

An eleventh embodiment can include the apparatus of any one of the first to tenth embodiments, wherein the one or more spherical spacers 40 are made of a non-galling material, having a coefficient of friction of less than or equal to about 0.2, 0.15, or 0.1.

A twelfth embodiment can include the apparatus of any one of the first to eleventh embodiments, wherein the outside diameter D4 of the spherical first end 50A of the spherical bolt 50 is less than the inside diameter of the alignment coupler body by greater than or equal to about 0.03, 0.04, or 0.05 in (0.76, 1.02, or 1.27 mm).

A thirteenth embodiment can include the apparatus of any one of the first to twelfth embodiments, wherein a threaded motor drive shaft contact surface 80C of the alignment coupler body 80 is threadably coupled with a threaded alignment coupler body contact surface 30E of the first end 30A of the motor drive shaft 30.

A fourteenth embodiment can include the apparatus of any one of the first to thirteenth embodiments, wherein an axially opposite surface 42 (e.g., axially opposite surface 42A of first spherical spacer 40A) of one of the one or more spherical spacers 40 (e.g., first spherical spacer 40A) is adjacent the spring section 60.

A fifteenth embodiment can include the apparatus of the fourteenth embodiment, wherein the axially opposite surface 42 (e.g., axially opposite surface 42B of second spherical spacer 40B) of another of the one or more spherical spacers 40 (e.g., second spherical spacer 40B) contacts the alignment coupler body 80.

A sixteenth embodiment can include the apparatus of any one of the first to fifteenth embodiments, wherein the alignment coupler 10 enables an radial float D2 of the spherical bolt 50 along the central axis C of greater than or equal to about ±0.02 inch, ±0.025 in, or ±0.03 inch (±0.5 mm, ±0.6 mm, or ±0.8 mm).

A seventeenth embodiment can include the apparatus of any one of the first to sixteenth embodiments, wherein the alignment coupler 10 enables spherical movement D1 of the spherical bolt 50 of greater than or equal to about 1, 2, or 3 degrees (°).

An eighteenth embodiment can include the apparatus of any one of the first to seventeenth embodiments, further comprising a motor 108 connected to the motor drive shaft 30.

A nineteenth embodiment can include the apparatus of any one of the first to eighteenth embodiments, further comprising a component coupled to a second end 20B of the component drive shaft 20, wherein the component comprises a mud pulser valve 90, and the apparatus 100 comprises a mud pulser.

A twentieth embodiment can include the apparatus of any one of the first to nineteenth embodiments, further comprising one or more bearings 102 supporting the component drive shaft 20 within the housing 11.

A twenty first embodiment can include the apparatus of the nineteenth embodiment or the twentieth embodiment further comprising a spring radially positioned between the alignment coupler 10 and the housing 11.

A twenty second embodiment can include the apparatus of any one of the nineteenth to twenty first embodiments, wherein the mud pulser is a component of a bottom hole assembly (BHA) 210.

A twenty third embodiment can include the apparatus of any one of the nineteenth to twenty second embodiments, wherein the mud pulser is within a sonde mounted inside an inside diameter of a drill collar 212.

A twenty fourth embodiment can include the apparatus of any one of the nineteenth to twenty third embodiments, wherein the mud pulser further comprises a motor 108.

In a twenty fifth embodiment, a method comprises: assembling a tool 100 with a multi-component drive shaft 25 comprising a motor drive shaft 30 and a component drive shaft 20 coupled via an alignment coupler 10 by: coupling the component drive shaft 20 with the motor drive shaft 30 via the alignment coupler 10 to provide the multi-component drive shaft 25, wherein the alignment coupler 10 comprises: an alignment coupler body 80 having an alignment coupler body throughbore 81 extending therethrough; a spherical bolt 50 comprising a spherical first end 50A and an elongated section 55 extending from the spherical first end to a second end 50B; a thermally expandable material (TEM) section 70; a spring section 60; and one or more spherical spacers 40, wherein the spherical first end 50A of the spherical bolt 50 is disposed within the alignment coupler body throughbore 81, wherein the second end 50B of the spherical bolt 50 is coupled with a first end 20A of the component drive shaft 20, wherein the TEM section 70 comprises a ring of TEM 71 disposed within a cavity 30D defined by a first end 30A of the motor drive shaft 30, wherein the spring section 60 is disposed within the cavity 30D defined by the first end 30A of the motor drive shaft 30, and is positioned axially between the TEM section 70 and the spherical first end 50A of the spherical bolt 50, and wherein the one or more spherical spacers 40 are positioned between an outside diameter D4 of the spherical first end 50A of the spherical bolt 50 and an inside diameter D5 of the alignment coupler body 80; aligning the multi-component drive shaft 25 within the housing 11; and heating the TEM section 70, whereby the TEM 71 expands axially to lock the multi-component drive shaft 25 in position within the housing 11.

A twenty sixth embodiment can include the method of the twenty fifth embodiment, wherein heating comprises heating to a temperature above a transition temperature above which the TEM 71 begins to expand.

A twenty seventh embodiment can include the method of the twenty sixth embodiment, wherein the transition temperature is in a range of from about 75° C. to about 175° C., from about 100° C. to about 150° C., or from about 110° C. to about 140° C.

A twenty eighth embodiment can include the method of any one of the twenty sixth or twenty seventh embodiments or the apparatus of any one of the first to twenty fourth embodiments, wherein the TEM 71 comprises a shape memory alloy (SMA).

A twenty ninth embodiment can include the method of the twenty eighth embodiment, wherein the SMA comprises copper-aluminum-nickel, nickel-titanium (NiTi), iron-manganese-silicon (Fe—Mn—Si), copper-zinc-aluminum (Cu—Zn—Al), copper-aluminum-nickel (Cu—Al—Ni), nickel-titanium-iron (NiTiFe), nickel-titanium-niobium (NiTiNb), or a combination thereof.

A thirtieth embodiment can include the method of any one of the twenty eighth to twenty ninth embodiments, wherein the SMA comprises an alloy of zinc, copper, gold, iron, aluminum, nickel, titanium, manganese, niobium, and/or silicon.

A thirty first embodiment can include the method of any one of the twenty fifth to thirtieth embodiments, wherein the tool 100 comprises a positive displacement pump, a mud pulser, a rotary steerable tool, a logging while drilling (LWD) tool, a mud sampling tool, or a downhole generator.

A thirty second embodiment can include the method of any one of the twenty fifth to thirty first embodiments, further comprising: operating the tool 100 for an operating time; replacing one or more components of the tool 100, to provide a maintained tool 100; and operating the maintained tool 100 for another operating time.

A thirty third embodiment can include the method of the thirty second embodiment, wherein replacing the one or more components of the tool 100 further comprises cooling the TEM section 70 to a temperature at which the TEM 71 contracts and decoupling the component drive shaft 20 from the multi-component drive shaft 25.

A thirty fourth embodiment can include the method of any one of the thirty second to thirty third embodiments, wherein replacing the one or more components further comprises decoupling the component drive shaft 20 from the multi-component drive shaft 25 and replacing the decoupled component drive shaft 20 with a new component drive shaft 20.

A thirty fifth embodiment can include the method of any one of the twenty fifth to thirty fourth embodiments, wherein coupling the component drive shaft 20 with the motor drive shaft 30 further comprises: positioning the spherical first end 50A of the spherical bolt 50 and the one or more spherical spacers 40 within the alignment coupler body 80; coupling the second end 50B of the spherical bolt 50 with the first end 20A of the component drive shaft 20; and coupling the first end 30A of the motor drive shaft 30 with the alignment coupler body 80.

A thirty sixth embodiment can include the method of the thirty fifth embodiment, wherein coupling the second end 50B of the spherical bolt 50 with the first end 20A of the component drive shaft 20 further comprises threading a threaded spherical bolt contact portion 20D of the component drive shaft 20 with a threaded component drive shaft contact portion 50D of the spherical bolt 50.

A thirty seventh embodiment can include the method of any one of the thirty fifth or thirty sixth embodiments, wherein coupling the first end 30A of the motor drive shaft 30 with the alignment coupler body 80 further comprises threading a threaded motor drive shaft contact surface 80C of the alignment coupler body 80 with a threaded alignment coupler body contact surface 30E of the first end 30A of the motor drive shaft 30.

A thirty eighth embodiment can include the method of any one of the thirty fifth to thirty seventh embodiments, wherein positioning the spherical first end 50A of the spherical bolt 50 and the one or more spherical spacers 40 within the alignment coupler body 80 further comprises passing the second end 50B of the spherical bolt 50 through the alignment coupler body throughbore 81.

A thirty ninth embodiment can include the method of the thirty eighth embodiment, further comprising positioning a first spherical spacer 40A, a second spherical spacer 40B, or both a first spherical spacer 40A and a second spherical spacer 40B about an outside diameter D4 of the first end 50A of the spherical bolt 50 prior to positioning the spherical first end 50A of the spherical bolt 50 and the one or more spherical spacers 40 within the alignment coupler body 80, whereby a spherical surface 41A of the first spherical spacer 40A contacts a front spherical surface 51A of the first end 50A of the spherical bolt 50 and a spherical surface 41B of the second spherical spacer 40B contacts a back spherical surface 51B of the first end 50A of the spherical bolt 50.

A fortieth embodiment can include the method of any one of the thirty fifth to thirty ninth embodiments, further comprising positioning the TEM 71 in the TEM section 70 within the cavity 30D defined by the motor drive shaft 30 and positioning one or more springs in the spring section 60 within the cavity defined by the motor drive shaft 30 prior to coupling the first end 30A of the motor drive shaft 30 with the alignment coupler body 80, whereby a first end 60A of the spring section 60 contacts one of the one or more spacers and a second end 60B of the spring section contacts the TEM 71 of the TEM section 70.

A forty first embodiment can include the method of the fortieth embodiment, wherein coupling the first end 30A of the motor drive shaft 30 with the alignment coupler body 80 causes the spring section 60 to apply a pre-load pressure on the spherical bolt 50.

A forty second embodiment can include the method of any one of the twenty fifth to forty first embodiments, wherein the tool comprises a mud pulser, wherein the component drive shaft 20 is a valve drive shaft 20, and the second end 20B of the component drive shaft 20 is further coupled with a valve 90.

A forty third embodiment can include the method of the forty second embodiment, wherein a second end 30B of the motor drive shaft 30 is coupled with a motor 108.

In a forty fourth embodiment, a mud pulser assembly comprises: a housing 11 having a housing throughbore 11A extending therethrough along a central axis C; a motor drive shaft 30 disposed in the housing throughbore 11A and coupled to a motor 108; a valve drive shaft 20 disposed in the housing throughbore 11A and coupled to a valve 90; and an alignment coupler 10 mechanically coupling the motor drive shaft 30 with the valve drive shaft 20, wherein the alignment coupler 10 comprises: an alignment coupler body 80 having an alignment coupler body throughbore 81 extending therethrough; a spherical bolt 50 comprising a spherical first end 50A and an elongated section 55 extending from the spherical first end to a second end 50B; a thermally expandable material (TEM) section 70; a spring section 60 comprising one or more springs 61; and one or more spherical spacers 40, wherein the spherical first end 50A of the spherical bolt 50 is disposed within the alignment coupler body throughbore 81, wherein the second end 50B of the spherical bolt 50 is coupled with a first end 20A of the valve drive shaft 20, wherein the TEM section 70 comprises a ring of TEM 71 disposed within a cavity 30D defined by a first end 30A of the motor drive shaft 30, wherein the spring section 60 is disposed within the cavity 30D defined by the first end 30A of the motor drive shaft 30, and is positioned axially between the TEM section 70 and the spherical first end 50A of the spherical bolt 50, and wherein the one or more spherical spacers 40 are positioned between an outside diameter D4 of the spherical first end 50A of the spherical bolt 50 and an inside diameter D5 of the alignment coupler body 80.

In a forty fifth embodiment, a multi-component drive shaft 25 comprises a motor drive shaft 30 and a component drive shaft 20 coupled via an alignment coupler 10, wherein the alignment coupler 10 comprises: an alignment coupler body 80 having an alignment coupler body throughbore 81 extending therethrough; a spherical bolt 50 comprising a spherical first end 50A and an elongated section 55 extending from the spherical first end 50A to a second end 50B; a thermally expandable material (TEM) section 70; a spring section 60 comprising one or more springs 61; and one or more spherical spacers 40; wherein the spherical first end 50A of the spherical bolt 50 is disposed within the alignment coupler body throughbore 81, wherein the second end 50B of the spherical bolt 50 is coupled with a first end 20A of the component drive shaft 20, wherein the TEM section 70 comprises a ring of TEM 71 disposed within a cavity 30D defined by a first end 30A of the motor drive shaft 30, wherein the spring section 60 is disposed within the cavity 30D defined by the first end 30A of the motor drive shaft 30, and is positioned axially between the TEM section 70 and the spherical first end 50A of the spherical bolt 50, and wherein the one or more spherical spacers 40 are positioned between an outside diameter D4 of the spherical first end 50A of the spherical bolt 50 and an inside diameter D5 of the alignment coupler body 80.

In a forty sixth embodiment, a wellbore servicing equipment 100 comprises: an alignment coupler 10 mechanically coupling a first component 20 with a second component 30, wherein the alignment coupler 10 comprises: an alignment coupler body 80 having an alignment coupler body throughbore 81 extending therethrough; a spherical bolt 50 comprising a spherical first end 50A and an elongated section 55 extending from the spherical first end to a second end 50B; a thermally expandable material (TEM) section 70; a spring section 60 comprising one or more springs 61; and one or more spherical spacers 40, wherein the spherical first end 50A of the spherical bolt 50 is disposed within the alignment coupler body throughbore 81, wherein the second end 50B of the spherical bolt 50 is coupled with a first end 20A of the first component 20, wherein the TEM section 70 comprises a TEM 71 disposed within a cavity 30D defined by a first end 30A of the second component 30, wherein the spring section 60 is disposed within the cavity 30D defined by the first end 30A of the second component 30, and is positioned axially between the TEM section 70 and the spherical first end 50A of the spherical bolt 50, and wherein the one or more spherical spacers 40 are axially positioned between an outside diameter D4 of the spherical first end 50A of the spherical bolt 50 and an inside diameter D5 of the alignment coupler body 80.

A forty seventh embodiment can include the wellbore servicing equipment of the forty sixth embodiment, wherein the wellbore servicing equipment comprises a mud pulser, and wherein the first component 20 comprises a valve drive shaft mechanically coupled to a mud pulser valve and the second component comprises a motor drive shaft 30 mechanically coupled to a motor 108.

A forty eighth embodiment can include the wellbore servicing equipment of any one of the forty sixth or forty seventh embodiments, wherein the wellbore servicing equipment comprises a positive displacement pump, wherein the first component 20 comprises a reciprocating element drive shaft mechanically coupled to a reciprocating element, and wherein the second component 30 comprises a motor drive shaft mechanically coupled to a motor 108.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A wellbore servicing equipment comprising:

an alignment coupler mechanically coupling a first component with a second component, wherein the alignment coupler comprises:

an alignment coupler body having an alignment coupler body throughbore extending therethrough along a central axis;

a spherical bolt comprising a spherical first end and an elongated section extending from the spherical first end to a second end;

a thermally expandable material (TEM) section;

a spring section comprising one or more springs; and one or more spherical spacers, wherein the spherical first end of the spherical bolt is disposed within the alignment coupler body throughbore, wherein the second end of the spherical bolt is coupled with a first end of the first component, wherein the TEM section comprises a TEM disposed within a cavity defined by a first end of the second component, wherein the spring section is disposed within the cavity defined by the first end of the second component, and is positioned axially along the central axis between the TEM section and the spherical first end of the spherical bolt, wherein each of the one or more spherical spacers comprises a spherical surface in contact with a spherical surface of the spherical first end of the spherical bolt, and wherein the spherical first end of the spherical bolt further comprises a cutout section on a front thereof, wherein a first end of the second component further comprises a central section axially aligned with the cutout section, such that should the second component be compressed axially toward the spherical bolt, the central section of the second component can extend into the cutout section.

2. The wellbore servicing equipment of claim 1, wherein the wellbore servicing equipment comprises a mud pulser, and wherein the first component comprises a valve drive shaft mechanically coupled to a mud pulser valve and the second component comprises a motor drive shaft mechanically coupled to a motor.

3. The wellbore servicing equipment of claim 1, wherein the wellbore servicing equipment comprises a positive displacement pump, wherein the first component comprises a reciprocating element drive shaft mechanically coupled to a reciprocating element, and wherein the second component comprises a motor drive shaft mechanically coupled to a motor.

4. An apparatus comprising:

a housing having a housing throughbore extending therethrough along a central axis;

a motor drive shaft disposed in the housing throughbore;

a component drive shaft disposed in the housing throughbore; and an alignment coupler mechanically coupling the motor drive shaft with the component drive shaft, wherein the alignment coupler comprises:

an alignment coupler body having an alignment coupler body throughbore extending therethrough along the central axis;

a spherical bolt comprising a spherical first end and an elongated section extending from the spherical first end to a second end;

a thermally expandable material (TEM) section;

a spring section comprising one or more springs; and one or more spherical spacers, wherein the spherical first end of the spherical bolt is disposed within the alignment coupler body throughbore, wherein the second end of the spherical bolt is coupled with a first end of the component drive shaft, wherein the TEM section comprises a TEM disposed within a cavity defined by a first end of the motor drive shaft, wherein the spring section is disposed within the cavity defined by the first end of the motor drive shaft, and is positioned axially along the central axis between the TEM section and the spherical first end of the spherical bolt, wherein each of the one or more spherical spacers comprises a spherical surface in contact with a spherical surface of the spherical first end of the spherical bolt, and wherein the spherical first end of the spherical bolt further comprises a cutout section on a front thereof, wherein a first end of the motor drive shaft further comprises a central section axially aligned with the cutout section, such that should the motor drive shaft be compressed axially toward the spherical bolt, the central section of the motor drive shaft can extend into the cutout section.

5. The apparatus of claim 4, wherein the apparatus is an oilfield services tool.

6. The apparatus of claim 4, wherein the spherical first end of the spherical bolt further comprises a cutout section.

7. The apparatus of claim 4, wherein the TEM comprises shape memory alloy.

8. The apparatus of claim 4, wherein the TEM has a coefficient of thermal expansion of greater than or equal to about $2\times10^{-5}$ in/in/° F.

9. The apparatus of claim 4, wherein the spring section comprises one or a plurality of Belleville springs.

10. The apparatus of claim 4, wherein the one or more spherical spacers comprise a first spherical spacer and a second spherical spacer, wherein the spherical surface of the first spherical spacer is in contact with a front spherical surface of the spherical first end of the spherical bolt, and wherein the spherical surface of the second spherical spacer is in contact with a back spherical surface of the spherical first end of the spherical bolt.

11. The apparatus of claim 4, wherein a threaded motor drive shaft contact surface of the alignment coupler body is threadably coupled with a threaded alignment coupler body contact surface of the first end of the motor drive shaft.

12. The apparatus of claim 4, wherein an axially opposite surface of one of the one or more spherical spacers is adjacent the spring section; and wherein the axially opposite surface of another of the one or more spherical spacers contacts the alignment coupler body.

13. An apparatus comprising:

a housing having a housing throughbore extending therethrough along a central axis;

a motor drive shaft disposed in the housing throughbore;

a component drive shaft disposed in the housing throughbore; and an alignment coupler mechanically coupling the motor drive shaft with the component drive shaft, wherein the alignment coupler comprises:

an alignment coupler body having an alignment coupler body throughbore extending therethrough along the central axis;

a spherical bolt comprising a spherical first end and an elongated section extending from the spherical first end to a second end;

a thermally expandable material (TEM) section;

a spring section comprising one or more springs; and one or more spherical spacers, wherein the spherical first end of the spherical bolt is disposed within the alignment coupler body throughbore, wherein the second end of the spherical bolt is coupled with a first end of the component drive shaft, wherein the TEM section comprises a TEM disposed within a cavity defined by a first end of the motor drive shaft, wherein the spring section is disposed within the cavity defined by the first end of the motor drive shaft, and is positioned axially along the central axis between the TEM section and the spherical first end of the spherical bolt, wherein each of the one or more spherical spacers comprises a spherical surface in contact with a spherical surface of the spherical first end of the spherical bolt, and wherein the alignment coupler enables a radial float of the spherical bolt along the central axis; and/or wherein the alignment coupler enables spherical movement of the spherical bolt.

14. The apparatus of claim 4 further comprising a component coupled to a second end of the component drive shaft, wherein the component comprises a mud pulser valve, and the apparatus comprises a mud pulser.

15. A method comprising:

assembling a tool with a multi-component drive shaft comprising a motor drive shaft and a component drive shaft coupled via an alignment coupler by:

coupling the component drive shaft with the motor drive shaft via the alignment coupler to provide the multi-component drive shaft, wherein the alignment coupler comprises: an alignment coupler body having an alignment coupler body throughbore extending therethrough along a central axis; a spherical bolt comprising a spherical first end and an elongated section extending from the spherical first end to a second end; a thermally expandable material (TEM) section; a spring section; and one or more spherical spacers, wherein the spherical first end of the spherical bolt is disposed within the alignment coupler body throughbore, wherein the second end of the spherical bolt is coupled with a first end of the component drive shaft, wherein the TEM section comprises a TEM disposed within a cavity defined by a first end of the motor drive shaft, wherein the spring section is disposed within the cavity defined by the first end of the motor drive shaft, and is positioned axially along the central axis between the TEM section and the spherical first end of the spherical bolt, wherein each of the one or more spherical spacers comprises a spherical surface in contact with a spherical surface of the spherical first end of the spherical bolt, and wherein the spherical first end of the spherical bolt further comprises a cutout section on a front thereof, wherein a first end of the motor drive shaft further comprises a central section axially aligned with the cutout section, such that should the motor drive shaft be compressed axially toward the spherical bolt, the central section of the motor drive shaft can extend into the cutout section;

aligning the multi-component drive shaft within a housing; and heating the TEM section, whereby the TEM expands axially to lock the multi-component drive shaft in position within the housing.

16. The method of claim 15, wherein heating comprises heating to a temperature above a transition temperature above which the TEM begins to expand.

17. The method of claim 16, wherein the TEM comprises a shape memory alloy (SMA).

18. The method of claim 17, wherein the SMA comprises nickel-titanium (NiTi), iron-manganese-silicon (Fe—Mn—Si), copper-zinc-aluminum (Cu—Zn—Al), copper-aluminum-nickel (Cu—Al—Ni), nickel-titanium-iron (NiTiFe), nickel-titanium-niobium (NiTiNb), or a combination thereof.

19. The method of claim 15 further comprising:

operating the tool for an operating time;

replacing one or more components of the tool, to provide a maintained tool; and operating the maintained tool for another operating time.

20. The method of claim 19, wherein replacing the one or more components of the tool further comprises cooling the TEM section to a temperature at which the TEM contracts and decoupling the component drive shaft from the multi-component drive shaft.

21. The apparatus of claim 13, wherein the radial float is greater than or equal to about ±0.02 inch (±0.5 mm); and/or wherein the spherical movement is greater than or equal to about 1 degree (°).

* * * * *